US008096206B2

(12) United States Patent
König

(10) Patent No.: US 8,096,206 B2
(45) Date of Patent: Jan. 17, 2012

(54) CONTROL DEVICE

(75) Inventor: Bernhard König, Bobingen (DE)

(73) Assignee: Liebherr-Aerospace Lindenberg GmbH, Lindenberg/Allgäu (DE)

( * ) Notice: Subject to any disclaimer, the term of this patent is extended or adjusted under 35 U.S.C. 154(b) by 1046 days.

(21) Appl. No.: 11/999,365

(22) Filed: Dec. 5, 2007

(65) Prior Publication Data

US 2009/0146018 A1 Jun. 11, 2009

(51) Int. Cl.
*G05G 9/047* (2006.01)

(52) U.S. Cl. ..... 74/471 XY

(58) Field of Classification Search ..... 74/471 XY, 74/471 R; 345/158, 161; 244/220, 221, 244/237

See application file for complete search history.

(56) References Cited

U.S. PATENT DOCUMENTS

| | | | | |
|---|---|---|---|---|
| 1,557,214 | A | 10/1925 | McLane | |
| 2,381,217 | A | 8/1945 | Harman | |
| 4,422,345 | A | 12/1983 | Green | |
| 6,429,849 | B1 * | 8/2002 | An et al. | 345/161 |
| 6,708,580 | B1 * | 3/2004 | Smith et al. | 74/471 XY |

FOREIGN PATENT DOCUMENTS

| | | |
|---|---|---|
| DE | 722 390 | 7/1942 |
| DE | 7829428 | 1/1979 |
| DE | 103 05 261 | 8/2004 |
| EP | 1450231 | 8/2004 |
| EP | 1770 010 | 4/2007 |

* cited by examiner

*Primary Examiner* — Vicky Johnson
(74) *Attorney, Agent, or Firm* — Dilworth & Barrese, LLP.

(57) ABSTRACT

The invention relates to a control device, in particular for an aircraft, having a multiaxially tiltable joystick for the actuation of signal transducers, in particular for the pitch control and roll control of an aircraft, as well as having a cardan-like joint by means of which the joystick is tiltable about different pivot axes, said joint furthermore having at least one freewheel for a tilt movement of the joystick about one of the pivot axes. In accordance with the invention, the freewheel is formed by a lever mechanism or by an elastic component.

16 Claims, 1 Drawing Sheet

CONTROL DEVICE

The present invention relates to a control device, in particular a control device for an aircraft, comprising a multiaxially tiltable joystick for the actuation of control transducers, in particular for the pitch control and roll control of an aircraft, as well as a cardan-like joint by means of which the joystick can be tilted about different pivot axes.

BACKGROUND OF THE INVENTION

Joysticks for the control of aircraft are known from the prior art which can be tilted about two axes which are a transverse axis about which the joystick can be tilted forward and backward and a longitudinal axis about which the joystick can be tilted to the right and to the left. The corresponding tilt movements of the joystick are detected by transducers and then converted into control movements of the aircraft. In this connection, it is known from the prior art to use a cardan joint by means of which the joystick is pivotable about two axes, with there being a disadvantage with this already known solution that one of the two axles cannot be supported in a fixed position since it has to follow the pivot movements of the joystick about the other axle.

SUMMARY OF THE INVENTION

Starting from this, it is the underlying object of the present invention to provide an improved control device which can be made comparatively simple and compact.

This object is solved in accordance with the invention by the features described herein. Provision is accordingly made for the joint to have at least one freewheel for a tilt movement of the joystick about one of the pivot axes, with the freewheel being formed by a joint mechanism or by a component which has elastic properties in the direction of the freewheel. The joint mechanism or the elastic component connects the joystick to the joint indirectly or directly.

Provision is thus made in accordance with the invention to form a degree of freedom by the freewheel such that the joystick can execute tilt movements about one axis independently of the other axis, such that therefore the joystick is, for example, decoupled from roll movements with respect to pitch movements and/or from pitch movements with respect to roll movements. In accordance with the invention, the freewheel has a joint or an elastic component which connects the joystick to the cardan-like joint indirectly or directly. In the present solution, the movements are thus rotary. Furthermore, there is the possibility due to the use of the freewheel in accordance with the invention to integrate a drive or control motor into the kinematics such that it does not require any additional construction space. If an elastic component is used, provision is preferably made for it to behave elastically in the direction of the freewheel, but for it to be able to transmit forces in a direction perpendicular thereto.

The freewheel can be arranged such that the tilt movement of the joystick enabled by the freewheel extends in a plane in which the one of the pivot axes is disposed or which extends parallel to one of the pivot axes. It is conceivable to arrange the freewheel such that it enables a tilt movement of the joystick in a plane in which the longitudinal axis of the control device is disposed.

The joint can have first and second joint parts which are arranged such that they are pivotable independently of one another about different pivot axes. Provision is preferably made for the pivot axes of the joint to stand perpendicular on one another.

The freewheel can have a lever mechanism which includes a first lever which is connected to the joystick and a second lever which is pivotally connected to the first lever and to one of the joint parts. The connection can in each case take place indirectly or directly. The joint/lever mechanism can thus consist of two, or more than two, levers hingedly connected to one anther. Other structures having one or more joints, such as a drag chain, are generally also conceivable. A spring can, for example, be considered as the elastic element; however, the invention is not restricted thereto.

In this connection, the first lever is pivotally arranged at the joystick or at a bearing connected thereto.

The bearing can be formed by a ring which encompasses the joystick and to which the lever is hinged.

In a further embodiment of the invention, provision is made for the cardan-like joint to have two pivot axes and a freewheel for a tilt movement of the joystick about one of the pivot axes as well as a freewheel for a tilt movement of the joystick about the other pivot axis. In this connection, a freewheel can be formed by an elongate recess through which one of the pivot axes extends.

Provision is made in a particularly preferred embodiment of the invention for one or both of the pivot axles of the joint to be arranged in a stationary manner. In this embodiment of the invention, a control device is thus provided which has two independent axles which are stationary. It is, for example, conceivable that the pivot axles of the joint are arranged at a rack or at a housing of the control device. It is known from the prior art to provide active joystick controls of aircraft which have servomotors by means of which actuation movements of the joystick are simulated or by means of which, in aircraft having two joysticks, the control movements of one joystick are tracked to the other joystick. In a further embodiment of the invention, provision is thus made for the control device to have one or more control motors which are coupled to pivot axles of the joint such that the actuation of the control motor or motors results in a pivot movement of the joystick.

Provision is made in a further embodiment of the invention for the first and/or second joint parts to be closed in the peripheral direction, i.e. for example, to be made as an annular structure or in hoop shape, for example in U shape. Provision is preferably made for the joint parts to be pivotably supported at oppositely disposed sides.

Provision is furthermore preferably made for the control device to be made such that additional components such as sensors, centering devices and the like are arranged in a stationary manner.

BRIEF DESCRIPTION OF THE DRAWINGS

Further details and advantages of the invention will be explained in more detail with reference to an embodiment shown in the drawing.

DESCRIPTION OF THE PREFERRED EMBODIMENTS

Figure 1:
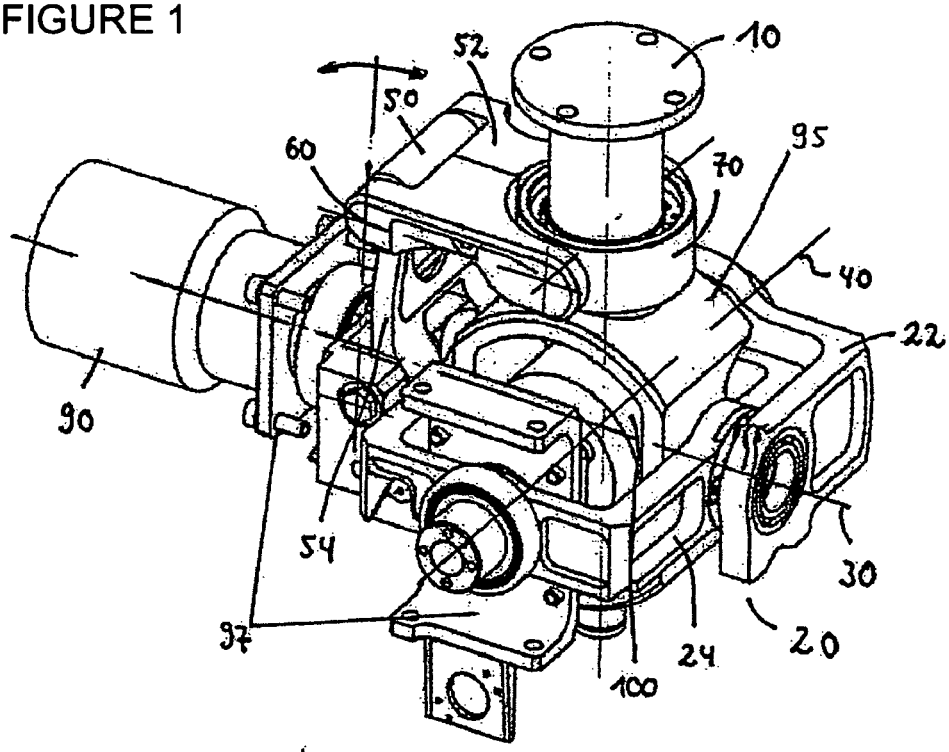
FIGS. 1 and 2 show the control device in accordance with the invention in different perspective representations.

The control device includes a joystick or a control actuator 10 which is tiltable about two pivot axes 30, 40, said pivot axes 30, 40 standing perpendicular on one another.

The joint 20 consists of a first joint part 22 pivotable about the pivot axis 30 and of a second joint part 24 pivotable about the pivot axis 40 perpendicular thereto.

The pivot axles 30, 40 are made stationary and are arranged, for example, at a housing which surrounds the control device shown in the Figures.

Figure 2:
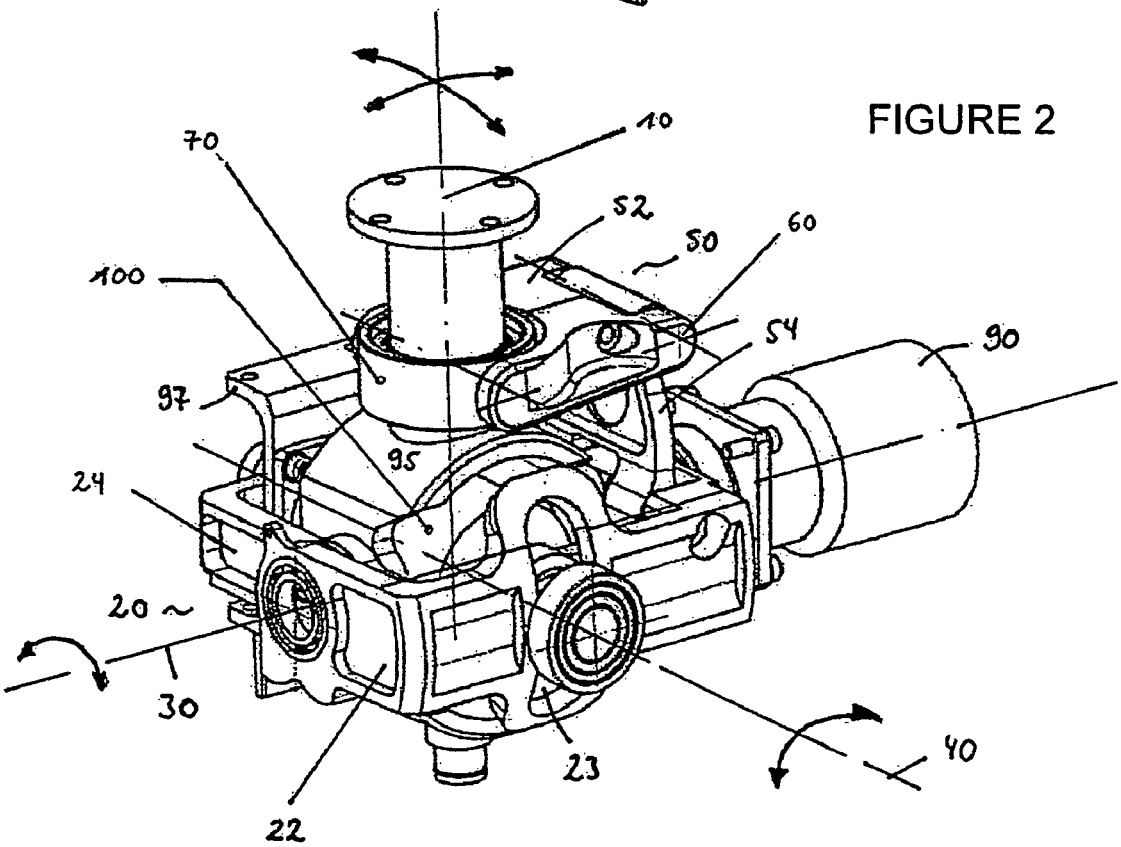

As can furthermore be seen from FIGS. 1 and 2, the joystick or the control actuator 10 is connected to the first joint part 22 via a joint/lever mechanism 50 such that the joystick 10 is pivotable about the axis 40 relative to the first joint part 22 and is thus also pivotable relative to the axis 30.

The joint/lever mechanism 50 consists of a first lever 52 which is pivotably hinged to the compensation bearing 70 for the relative movement and which is pivotably connected in its other end region to the second lever 54 which is in turn pivotably connected to the first joint part 22. This arrangement enables the joystick or the actuator 10 to be pivotable about the axis 40 without the first joint part 22 having to follow this pivot movement. The relative movement between the joystick/control actuator 10 and the first joint part 22 is made possible by the joint/lever mechanism 50. Reference numeral 60 designates the joint which connects the first lever 52 to the second lever 54.

A freewheel of the joystick 10 with respect to the pivot movement about the pivot axis 30 is made possible in that the first joint part 22 has an elongate recess 23 which enables the first pivot part 22 to pivot relative to the pivot axis 40. It is generally furthermore conceivable to design both freewheels in identical manner.

Control motors are marked by the reference numerals 90, 100 which enable a movement of the joystick 10 about the axis 30 or about the axis 40.

In this connection, the embodiment of the joint/lever mechanism 50 in accordance with the invention makes it possible to integrate one of the drives, namely the control motor 100, such that it does not need any additional construction space, as can be seen from the Figures. The drive 100 is located in the region bounded by the joint parts 22, 24. As can be seen from FIG. 1, the joint part 24 is closed in the peripheral direction, whereas the joint part 22 is made as a U-shaped hoop. An embodiment of the joint parts differing therefrom is generally also possible. The joint part 22 can, for example, also be made in L shape.

Reference numeral 95 finally designates the control actuator mount and reference numeral 97 designates the holders for the drives or control motors 90, 100.

In the embodiment shown in the Figures, the axles 30, 40 are arranged in a stationary manner and can, for example, be connected to a housing of the control device. The freewheel or lever mechanism in accordance with the invention makes it possible for all movements to be rotary in the present solution. A linear movement for the taking along of a second axle is not necessary in this embodiment of the freewheel.

If the axles are mounted in a stationary manner, there is also the advantage that additional components such as sensors, centering devices and the like can also be arranged in a stationary manner. The attachment of the sensor system and of the actuator system is facilitated and a simple conversion of the sensor components and actuator components for different control embodiments is also possible without problem.

If the axles are arranged in a stationary manner, no moved connection leads, sliding contacts or the like are accordingly needed.

The invention claimed is:

1. A control device, having a multiaxially tiltable joystick (10) for the actuation of signal transducers, a cardan joint (20) by which the joystick (10) is tiltable about different pivot axes (30, 40), wherein the cardan joint (20) furthermore has a first joint part (22) pivotally mounted about one (30) of the axes (30, 40), a second joint part (24) pivotally mounted about the other (40) of the axes (30, 40) and means (23) for maintaining said respective ioint part (22, 24) and axis (30, 40) in position when the joystick (10) is tilted about the other of said axes (30, 40), such that said respective joint part (22, 24) does not follow pivoting movement about the other of said axes (30, 40).

2. A control device in accordance with claim 1, configured such that tilt movement of the joystick (10) takes place in a plane in which one of the pivot axes (30) is disposed or which extends parallel to one of the pivot axes.

3. A control device in accordance with claim 2, including a lever mechanism (50) having a first lever (52) and second lever (54), said first lever (52) being pivotably connected to the joystick (10) or a bearing (70) connected thereto, and said second lever (54) being pivotably connected to the first lever (52) and to one of the joint parts (22) of the cardan joint (20).

4. A control device in accordance with claim 3, wherein the bearing is formed by a ring (70) which encompasses the joystick (10) and is hinged to the first lever (52).

5. A control device in accordance with claim 1, including a lever mechanism (50) having a first lever (52) and second lever (54), said first lever (52) being pivotably connected to the joystick (10) or a bearing (70) connected thereto, and said second lever (54) being pivotably connected to the first lever (52) and to one of the joint parts (22) of the cardan joint (20).

6. A control device in accordance with claim 5, wherein the bearing is formed by a ring (70) which encompasses the joystick (10) and is hinged to the first lever (52).

7. A control device in accordance with claim 1, additionally comprising an elongate recess (23) through which one of the pivot axes (40) extends.

8. A control device in accordance with claim 1, wherein one or both of the pivot axes (30, 40) of the cardan joint (20) are stationary.

9. A control device in accordance with claim 8, wherein the pivot axes (30, 40) of the cardan joint (20) are arranged at a rack or housing.

10. A control device in accordance with claim 1, wherein one or more control motors (90, 100) are coupled to pivot axles (30, 40) of the cardan joint (20) such that actuation of the control motor or motors (90, 100) results in pivot movement of the joystick (10).

11. A control device in accordance with claim 1, wherein the first and/or second joint parts (22, 24) are closed or made in hoop shape.

12. A control device in accordance with claim 11, wherein the first and/or second joint parts (22, 24) are made in U shape or L shape.

13. A control device in accordance with claim 1, wherein the joint parts (22, 24) are pivotably supported at oppositely disposed sides.

14. A control device in accordance with claim 1, comprising additional components arranged stationary.

15. A control device in accordance with claim 1, configured for an aircraft, wherein the signal transducers are arranged for pitch and roll of the aircraft.

16. A control device in accordance with claim 14, wherein the additional components including sensors and centering devices.

* * * * *